US006717058B2

(12) United States Patent
Booth et al.

(10) Patent No.: US 6,717,058 B2
(45) Date of Patent: Apr. 6, 2004

(54) MULTI-CONDUCTOR CABLE WITH TRANSPARENT JACKET

(75) Inventors: Carl S. Booth, Storrs, CT (US); Robert A. Wiggin, Middletown, CT (US); Gregory P. Vaupotic, Wallingford, CT (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 10/125,435

(22) Filed: Apr. 19, 2002

(65) Prior Publication Data

US 2003/0196829 A1 Oct. 23, 2003

(51) Int. Cl.[7] ..... H01B 7/00

(52) U.S. Cl. ..... 174/117 F; 174/117 FF; 174/120 R

(58) Field of Search ..... 174/27, 36, 110 R, 174/110 SR, 110 PM, 110 FC, 112, 113 R, 117 R, 117 F, 117 FF, 120 R, 120 AR, 120 SR; 156/47, 55, 73.1, 580.1, 580.2

(56) References Cited

U.S. PATENT DOCUMENTS

| | | | | | |
|---|---|---|---|---|---|
| 3,778,879 | A | | 12/1973 | Den Ottolander | 29/203 |
| 4,034,148 | A | * | 7/1977 | Lang | 174/34 |
| 4,096,006 | A | | 6/1978 | Paquin | 156/85 |
| 4,202,722 | A | | 5/1980 | Paquin | 156/436 |
| 4,218,581 | A | * | 8/1980 | Suzuki | 174/117 F |
| 4,277,642 | A | * | 7/1981 | Piper et al. | 174/117 F |
| 4,359,597 | A | | 11/1982 | Paquin et al. | 174/34 |
| 4,413,469 | A | * | 11/1983 | Paquin | 57/293 |
| 4,439,631 | A | | 3/1984 | Shields | 174/74 |
| 4,564,723 | A | * | 1/1986 | Lang | 174/36 |
| 4,606,595 | A | | 8/1986 | Dola | 339/99 |
| 4,767,891 | A | * | 8/1988 | Biegon et al. | 174/34 |
| 4,924,037 | A | * | 5/1990 | Ainsworth et al. | 174/117 F |
| 4,928,379 | A | | 5/1990 | Paquin et al. | 29/566.3 |
| 4,967,040 | A | * | 10/1990 | Viaud et al. | 174/36 |
| 4,973,238 | A | | 11/1990 | Kihlken et al. | 425/105 |
| 4,978,813 | A | * | 12/1990 | Clayton et al. | 174/117 F |
| 5,142,105 | A | | 8/1992 | Kihlken et al. | 174/112 |
| 5,387,298 | A | | 2/1995 | Takagi et al. | 156/47 |
| 5,900,588 | A | * | 5/1999 | Springer et al. | 174/117 F |
| 5,973,268 | A | * | 10/1999 | Cheng | 174/112 |
| 6,270,598 | B1 | | 8/2001 | Kasahara et al. | 156/47 |
| 6,348,651 | B1 | * | 2/2002 | Chou et al. | 174/27 |
| 6,388,194 | B1 | * | 5/2002 | Ryeczek | 174/112 |
| 6,392,155 | B1 | * | 5/2002 | Shimizu et al. | 174/117 F |
| 6,476,329 | B2 | * | 11/2002 | Tsukamoto et al. | 174/117 F |
| 2002/0088639 | A1 | * | 7/2002 | Tsai | 174/112 |

FOREIGN PATENT DOCUMENTS

| | | | | |
|---|---|---|---|---|
| DE | 3333996 A1 | * | 4/1984 | H01B/7/08 |
| DE | 3405302 | * | 9/1985 | H01B/7/00 |
| DE | 3513620 A | * | 10/1986 | H01B/7/04 |
| GB | 1432548 | * | 4/1976 | H01B/7/36 |
| JP | 03-057109 | * | 3/1991 | H01B/13/00 |
| JP | 2000-299017 | * | 10/2000 | H01B/7/08 |
| JP | 2001-184953 | * | 7/2001 | H01B/7/08 |
| JP | 2002/025354 | * | 1/2002 | H01B/7/08 |

* cited by examiner

*Primary Examiner*—William H. Mayo, III
(74) *Attorney, Agent, or Firm*—Blank Rome LLP

(57) ABSTRACT

The present invention is directed to a multi-conductor cable with a twisted pair section and a parallel section, wrapped in a transparent plastic jacket to form a generally uniform round-shaped cable. The transparent jacket allows the flat section to be identified so that the jacket may be removed at this location and the conductors in the flat section prepared for attachment to a connector for either point to point or daisy chain cables. Additionally, the individual conductors in the flat section of the cable are each attached to a support member that maintains the spacing of the conductors so that it may be quickly attached to the contact terminals of a connector.

12 Claims, 1 Drawing Sheet

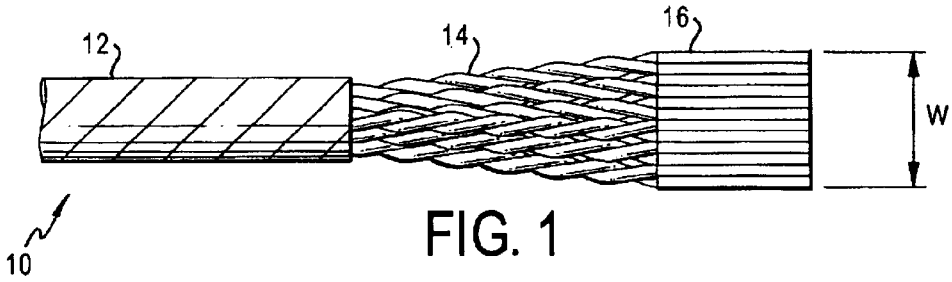
FIG. 1
FIG. 2
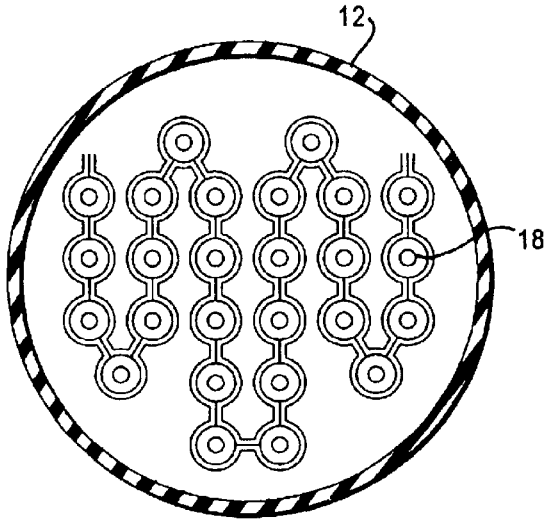
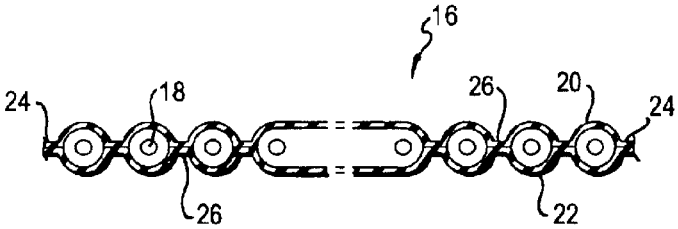
FIG. 3

MULTI-CONDUCTOR CABLE WITH TRANSPARENT JACKET

FIELD OF THE INVENTION

The present invention is directed to an electrical cable having a helically wrapped transparent plastic jacket for wrapping a multi-conductor cable having a twisted pair conductor section and a flat parallel conductor section into a generally uniform round-shaped cable. The transparent jacket allows the flat parallel conductor section to be quickly identified for easier mass termination and attachment to a connector.

BACKGROUND OF THE INVENTION

Mass termination connectors have become more commercially popular because of the time and cost savings compared to the traditional method of stripping and individually terminating each conductor using a crimp terminal. These connectors are often used with a flat ribbon-type cable in which several conductors run parallel to one another and are spaced to match the spacing of the terminal elements of the connector. The use of a flat cable allows the ends to be quickly attached to a connector without having to strip and position each of the conductors individually, as with traditional round cables. However, while flat cables offer advantages with respect to ease of termination, they are more difficult to route than round cables because they are less flexible, and consequently are more prone to damage. In addition, they cause significant airflow restriction problems within high performance electronic systems cabinets.

To overcome these disadvantages, cable manufacturers have taken standard flat cables with flat mass termination sections and manually folded them into a generally round-shaped cable, thus increasing the cable's flexibility and making it easier to route or lay the cable. In addition, cable manufacturers have usually manually covered this round-shaped cable with an additional covering such as nylon sleeving, or PVC tubing to protect the cable bundle. However, this method hinders the control of the cable's electrical properties because it is impossible with manual folding methods to predict how close the conductors are compressed together. A generally round-shaped cable has varying effective dielectric constants between the twisted pairs, due to the randomness of the manual folding and compression. This can cause wide variations in the cable's impedance and time delay, and consequently, increases the amount of reflection and crosstalk in the cable/connector system.

Another method of terminating a generally round cable is to take a standard round twisted pair cable having an extruded cover, remove the cover and then manually untwist each of the pairs on the end of the cable for termination. This process is costly due to the time and intensive labor involved. In addition, it is extremely costly to terminate the conductors when the connectors must be applied in the middle of the cable's length, as is the case with multi-drop SCSI cables.

Solutions to the above problems are suggested by U.S. Pat. No. 4,973,238 to Kihlken et al. which discloses a cable with a first twisted pair section and a second flat section wrapped in a non-transparent outer jacket into a generally round-shaped cable. A marker is placed on the outer jacket of the cable so that the location of the flat section of the cable can be identified for termination. However, it may be possible for the marker to be misplaced and incorrectly identify the location of the flat section.

Therefore it would be advantageous to provide a machine compacted uniformly round cable having a flat section for mass termination and attachment to a connector, and to provide a means for locating the flat section of the cable quickly and accurately. Such machine compaction would allow much more predictability of effective dielectric constant within the uniform round shape. It would also be advantageous to provide a means to easily strip the cable to expose the conductors therein for attachment to a connector, both at the ends and in the middle of the cable length.

SUMMARY OF THE INVENTION

The present invention is directed to a multi-conductor cable with a twisted pair section and a flat section, wrapped in a transparent plastic jacket to form a generally uniform round-shaped cable. The transparent jacket allows the flat section to be identified so that the jacket may be removed at this location and the flat section prepared for attachment to a connector for either point to point or daisy chain connection.

Additionally, the individual conductors in the flat section of the cable are each supported by a support member that maintains the spacing of the conductors. A connector having correspondingly spaced terminals can then be quickly attached to the conductors.

BRIEF DESCRIPTION OF THE DRAWINGS

FIG. 1 is a top view of a cable of the present invention showing its various sections;

FIG. 2 is an end view of a flat section of the cable wrapped in a round jacket; and FIG. 3 is an end view of the flat section of the cable with the jacket removed.

DETAILED DESCRIPTION OF DRAWINGS

Referring now in detail to the drawings, FIG. 1 shows a multi-conductor cable 10 of the present invention, with various sections of the cable 10 exposed for clarity. The cable 10 has a transparent outer jacket 12 that wraps the cable 10 into a generally uniform round shape. A portion of the outer jacket 12 has been removed to show a first section with twisted pair conductors 14, and a second section with flat parallel conductors 16. Although the first 14 and second 16 sections of the cable 10 are shown in FIG. 1 without the outer jacket 12, this is done for illustrative purposes, and in use, the outer jacket 12 wraps the twisted pair conductors 14 into a generally uniform round shape. The uniform round shape increases the cable's flexibility allowing it to bend and be routed more easily, as well as achieve tightly controlled electrical performance.

The cable 10 is comprised mostly of the twisted pair conductors 14 of the first section, with the flat parallel conductors 16 of the second section spaced at uniform or non-uniform intervals along the cable's length. Both sections are wrapped by the outer jacket 12, with the twisted pair section 14 being easily formed into the round shape, and the flat section 16, which comprises a series of conductors 18 spaced evenly apart in parallel fashion, folded over to form the round-shaped cable, as shown in FIG. 2. FIG. 2 shows a folded arrangement referred to as a zigzag fold. However, other fold arrangements may be used without departing from the invention so long as they result in a generally uniform round-shaped cable. In addition to being more easily formed into a round shape, the twisted pair section 14 reduces the crosstalk between the conductors 18 thereby enhancing the cable's electrical properties.

The transparent outer jacket 12 facilitates the preparation of the cable 10 for attachment to a connector (not shown) by allowing the flat section 16 to be easily located through the transparent jacket 12. The jacket 12 is may be made of a single or multi-layer clear Mylar, polyester plastic or other transparent material that has a heat activated adhesive that bonds the layers of the jacket to one another, but not to the conductors 18 lying underneath. A double layer of polyester is used for mechanical protection as well as the need to keep the wrapped polyester from unraveling. A clear extruded jacket could also be used, but it is difficult to strip these jackets without damaging the insulated conductors underneath. Although the preferred embodiment of the jacket 12 shown in FIG. 2 is a double-layered clear plastic, it should be understood that variations of the jacket are contemplated to be within the scope of the invention. For example, a single layer transparent jacket made from a variety of material may be used without departing from the intended purpose or spirit of the invention.

The conductors 18 in the flat section 16 may be supported by a support member such as by being bonded between a first and second semi-rigid plastic laminate material 20, 22. The plastic laminates 20, 22 extend the entire width W of the cable 10 and are attached at their ends 24 and at points 26 in between the conductors 18. The semi-rigid laminates 20, 22 provide an efficient and effective method of maintaining the spacing of the conductors 18, by keeping them uniformly spaced apart so that the conductors 18 may be quickly attached to a connector having contact terminals with the same spacing as the conductors 18. While FIG. 3 shows laminates 20, 22 completely encasing conductor 18, in other cables in which the spacing between conductors is smaller, laminates 20, 22 will not attach between conductors. Other types of support members may be used, including one which supports the conductors from only one side.

To prepare the cable 10 for mass termination and attachment to a connector (not shown), the flat section 16 of the cable is located through the transparent outer jacket 12 and the jacket is stripped off at that location. The jacket 12 is then removed from around the flat section 16 to expose the conductors 18. Because the outer jacket 12 is not bonded to the conductors 18, the jacket 12 can be stripped off the conductors 18 without damaging the conductors 18.

After the jacket 12 is removed, the conductors 18 comprising the flat section 16 are laid out in the manner shown in FIG. 3 such that the conductors 18 lie parallel to one another. FIG. 3 shows the flat section 16 with the laminates 20, 22 covering the conductors 18. The exposed conductors 18 are then attached to a connector by known means, such as by insulation displacement contacts.

Although preferred embodiments are specifically illustrated and described herein, it should be appreciated that many modifications and variations of the present invention are possible in light of the above teachings, without departing from the spirit or scope of the invention.

What is claimed is:

1. A multi-conductor electrical cable comprising:

a cable having a first section with conductors arranged in twisted pairs and a second section with conductors positioned serially in a contiguous manner; and a dual layer transparent jacket surrounding the cable in a generally uniform round configuration, the transparent jacket allowing the first section and second section to be seen through the transparent jacket, the two layers of the dual layer transparent jacket being bonded by a heat activated adhesive on their adjoining sides, and not adhesively bonded to the conductors so that the transparent jacket may be easily stripped from the conductors.

2. The multi-conductor electrical cable of claim 1, wherein the conductors in the second section are encased by semi-rigid laminates which maintains the conductors in a uniformly spaced relationship.

3. The multi-conductor electrical cable of claim 2, wherein the semi-rigid laminates comprises a first and second covering bonded to the conductors.

4. The multi-conductor electrical cable of claim 1, wherein a plurality of first sections are located at spaced intervals between a plurality of second sections along the length of the cable.

5. An electrical cable comprising:

a plurality of conductors having one or more flat sections wherein the conductors in the flat sections are configured parallel to one another, the conductors being individually wrapped by semi-rigid laminates so as to uniformly space each conductor; and a dual layer transparent jacket wrapped around the conductors so that the cable has a generally uniformly round shape, the two layers of the dual layer transparent jacket being bonded by a heat activated adhesive on their adjoining sides.

6. The electrical cable of claim 5, further comprising one or more twisted pair sections wherein pairs of conductors in the twisted pair section are intertwined, and the flat sections and the twisted pair sections alternate along the length of the cable.

7. The electrical cable of claim 5, wherein the semi-rigid laminates comprises first and second laminates bonded to each other.

8. The electrical cable of claim 5, wherein the transparent jacket is not bonded to the conductors.

9. A method of attaching a cable to a connector comprising the steps of:

providing a multi-conductor cable with a plurality of conductors therein, the cable having a first flat section and a second section, wherein in the first section the conductors are arranged in a continguous series, and the cable is wrapped in a dual layer transparent jacket in a generally uniformly round configuration the two layers of the dual layer transparent jacket being bonded to one another by a heat activated adhesive on their adjoining sides;

locating the first section of the cable by looking through the transparent jacket;

stripping the transparent jacket of the cable to expose the conductors in the first section; and attaching the conductors of the first section to a connector.

10. The method of attaching a cable to a connector of claim 9, wherein the conductors in the first section are encased in semi-rigid laminates that maintains the spacing of the conductors.

11. The method of attaching a cable to a connector of claim 10, wherein the transparent jacket is not bonded to the conductors so that when the transparent jacket is stripped it does not adhere to the conductors.

12. The method of attaching a cable to a connector of claim 9, further comprising the step of:

placing the conductors in the first section in a generally flat configuration for attachment to connector having contacts that correspond with the conductors.

* * * * *

UNITED STATES PATENT AND TRADEMARK OFFICE

CERTIFICATE OF CORRECTION

PATENT NO. : 6,717,058 B2 
DATED : April 6, 2004
INVENTOR(S) : Carl S. Booth, Robert A. Wiggin and Gregory P. Vaupotic It is certified that error appears in the above-identified patent and that said Letters Patent is hereby corrected as shown below:

Column 3,
Line 4, delete "is" after "jacket 12".

Column 4,
Line 39, change "first flat section" to -- first section --.

Signed and Sealed this

Eleventh Day of April, 2006

JON W. DUDAS
*Director of the United States Patent and Trademark Office*